US008231510B2

(12) United States Patent
Abdo

(10) Patent No.: US 8,231,510 B2
(45) Date of Patent: Jul. 31, 2012

(54) CONTOUR ELONGATED EXERCISE WEIGHT AND METHOD OF USE

(76) Inventor: John S. Abdo, Marina Del Rey, CA (US)

( * ) Notice: Subject to any disclaimer, the term of this patent is extended or adjusted under 35 U.S.C. 154(b) by 385 days.

(21) Appl. No.: 11/020,692

(22) Filed: Dec. 22, 2004

(65) Prior Publication Data

US 2005/0137063 A1 Jun. 23, 2005

Related U.S. Application Data

(60) Provisional application No. 60/532,107, filed on Dec. 22, 2003.

(51) Int. Cl.
*A63B 21/06* (2006.01)
*A63B 21/065* (2006.01)

(52) U.S. Cl. ..... 482/105; 482/93

(58) Field of Classification Search ..... 482/10–11, 482/44–50, 74, 79, 91–94, 105–110, 131–132, 482/139, 148; D21/662, 679–685; 5/636, 5/644, 653–654, 655.4, 702, 911; 383/6, 383/22, 24; 36/132; *A63B 21/06, 21/065*
See application file for complete search history.

(56) References Cited

U.S. PATENT DOCUMENTS

| | | | | |
|---|---|---|---|---|
| 1,005,791 | A | 10/1911 | Angell | |
| 2,219,948 | A | 10/1940 | Bundy | 272/57 |
| 3,343,837 | A | 9/1967 | Grzybowski | 272/83 |
| 3,468,534 | A | 9/1969 | Donato | 272/84 |
| 3,588,102 | A | 6/1971 | Gifford | 272/81 |
| 3,690,655 | A | 9/1972 | Chapman | 272/81 |
| 4,043,553 | A | 8/1977 | Suarez | 272/128 |
| 4,169,590 | A | 10/1979 | Johansen | 272/142 |
| 4,429,870 | A | 2/1984 | Gibbs | 272/117 |
| 4,513,963 | A | 4/1985 | Nelson et al. | 272/128 |
| 4,693,469 | A | 9/1987 | Cedar | 272/74 |
| 4,702,474 | A | 10/1987 | Guibert | 272/122 |
| 4,720,096 | A | 1/1988 | Rogers | 272/117 |
| 4,787,623 | A | 11/1988 | Cedar | 272/74 |
| 4,986,535 | A | 1/1991 | Hull et al. | 272/117 |
| 5,199,936 | A | 4/1993 | Moye | 482/148 |
| 5,375,278 | A | 12/1994 | VanWinkle et al. | 5/644 |
| 5,536,227 | A | 7/1996 | Polchek et al. | 482/93 |
| 5,628,713 | A | 5/1997 | Wilkinson | 482/74 |
| 5,653,664 | A | 8/1997 | Jennings | 482/93 |
| 5,735,779 | A | 4/1998 | Lay | 482/93 |
| 5,827,157 | A | 10/1998 | Lee | 482/93 |
| 5,839,992 | A | 11/1998 | Phillips | 482/49 |
| 5,839,996 | A | 11/1998 | Gooding | 482/106 |
| 5,857,946 | A * | 1/1999 | Brown | 482/108 |
| 5,857,948 | A | 1/1999 | Barnett | 482/140 |
| 5,868,651 | A | 2/1999 | Washington | 482/91 |
| 6,149,555 | A * | 11/2000 | Kinback | 482/93 |
| 6,224,517 | B1 | 5/2001 | Dereszynski | 482/93 |
| 6,293,893 | B1 | 9/2001 | Truchelut | 482/121 |
| 6,748,615 | B1 * | 6/2004 | Tiedemann | 5/640 |

FOREIGN PATENT DOCUMENTS

| | | |
|---|---|---|
| DE | 299 02 059 | 4/1999 |
| FR | 2 612 787 A | 9/1988 |
| WO | WO 98/43505 | 10/1998 |
| WO | WO 03/092823 | 11/2003 |

* cited by examiner

*Primary Examiner* — Oren Ginsberg
(74) *Attorney, Agent, or Firm* — Peter J. Ims; Westman, Champlin & Kelly, P.A.

(57) ABSTRACT

An exercising device includes an elongated tube with a central axis that is filled with a particulate material of a selected weight. The particulate material shifts within the elongated tube to provide flexibility along the length of the tube and wherein the elongated tube compresses when pressure is applied thereto.

13 Claims, 12 Drawing Sheets

FIG. 19
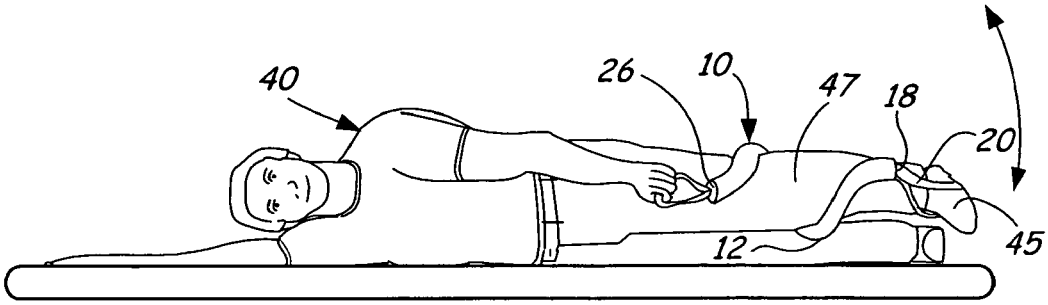
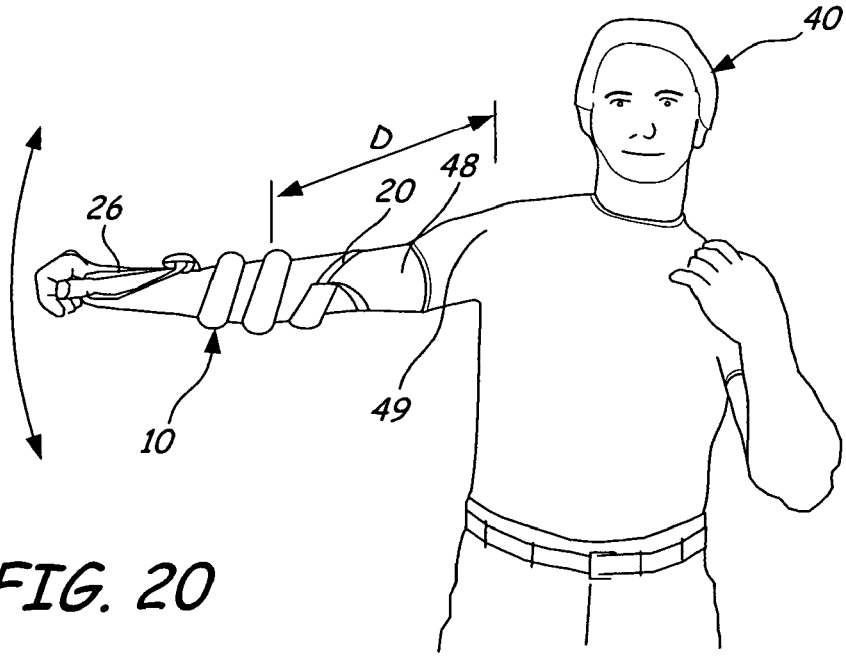
FIG. 20

CONTOUR ELONGATED EXERCISE WEIGHT AND METHOD OF USE

CROSS REFERENCE TO RELATED APPLICATION(S)

The present application claims the benefit of U.S. Provisional Application Ser. No. 60/532,107 filed on Dec. 22, 2003.

BACKGROUND OF THE INVENTION

The present invention relates to an exercise weight which was an elongated tubular cover and filled with a particulate material that is flexible so it may conform to various portions of the body. In particular, the exercise weight has a length that is retainable over the shoulders, around the neck or mid-section and includes stirrups or hand loops at the opposite ends of the elongated tubular cover which carry fasteners or a buckle to permit forming the weight into a loop or circular enclosure.

In the prior art, various types of exercise weights have been used, including multi-functional devices that have various hinged sections, and form elongated weights that can be lifted and twisted. Elongated bars with handles at opposite ends have been used as well. Additionally, the use of flexible members that are elongated and can be grasped by the hands have been provided.

However, a versatile, adjustable length, conformable and flexible weight that can be used in an enclosed loop, or in an elongated form, is desirable.

SUMMARY OF THE INVENTION

The present invention includes an exercising device having an elongated tube with a central axis that is filled with a particulate material of a selected weight. The particulate material shifts within the elongated tube to provide flexibility along the length of the tube and wherein the elongated tube compresses when pressure is applied thereto.

BRIEF DESCRIPTION OF THE DRAWINGS

FIG. 19 is a perspective view of the exerciser coiling a flexible weight about the leg and performing leg raising exercises while lying on a side; and FIG. 20 is a perspective view of the exerciser having a flexible weight coiled about the arm and performing arm raising exercises.

DESCRIPTION OF THE PREFERRED EMBODIMENT

Figure 1:
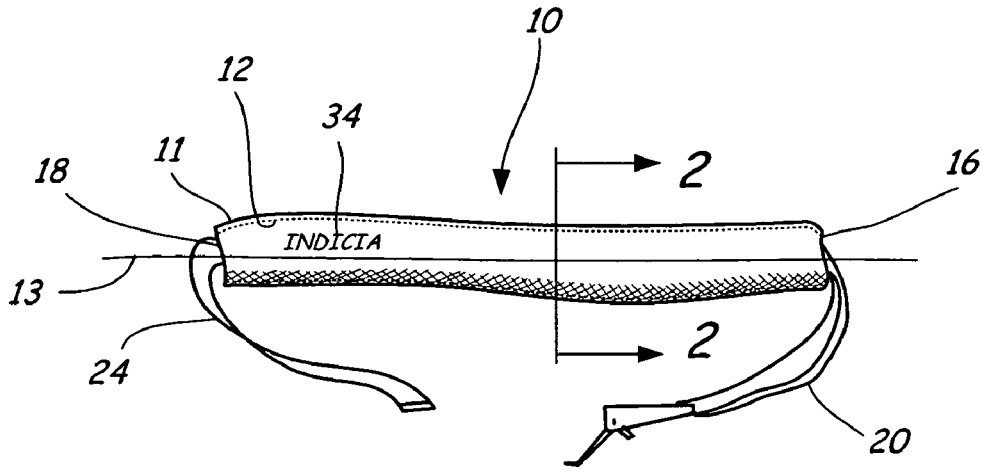
FIG. 1 is a perspective view of the elongated flexible weight of the present invention.
Figure 2:
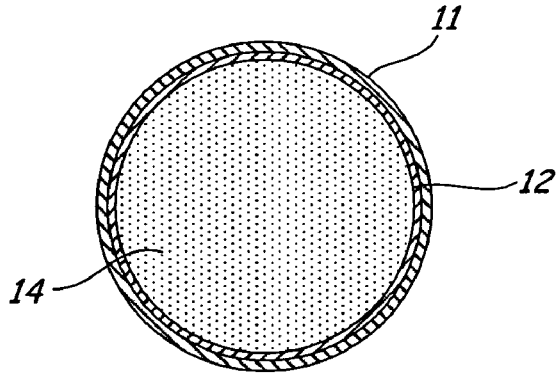
FIG. 2 is a sectional view of the elongated flexible weight along section line 2--2 in FIG. 1.

A flexible weight of the present invention is illustrated generally at 10 in FIG. 1. Referring to FIGS. 1 and 2, the flexible weight 10 has an elongated sleeve or tube 12 filled with a selected amount of a particulate material or granular material 14 such that the flexible weight 10 has a desired weight.

After being filled with the particulate material or granular material 14, the tube 12 is closed at its ends 16 and 18. The tube 12 can be seamed in a suitable manner by sewing it at its ends and along a length, if desired, and can be made of a material that can be pre-formed into a tubular shape with one end open for filling. The tube 12 can be closed by sewing it together or with adhesives or heat sealed, or in other ways as well. The granular material 14 is generally a dry material such as a dry sand, small rock, various type of metal shot, hollow spheres, and the like.

The tube 12 has a generally circular cross section and a central axis 13 running the length of the tube. The tube 12 is generally of a cloth-like material so that it is comfortable against the skin of a person, and which is a durable material as well to avoid excessive wear.

Optionally, the tube 12 may be covered by a sleeve 11. The sleeve 11 is preferably removable from the tube 12 and is capable of being washed to remove dirt and perspiration and also to provide additional protection to the exerciser.

Figure 3:
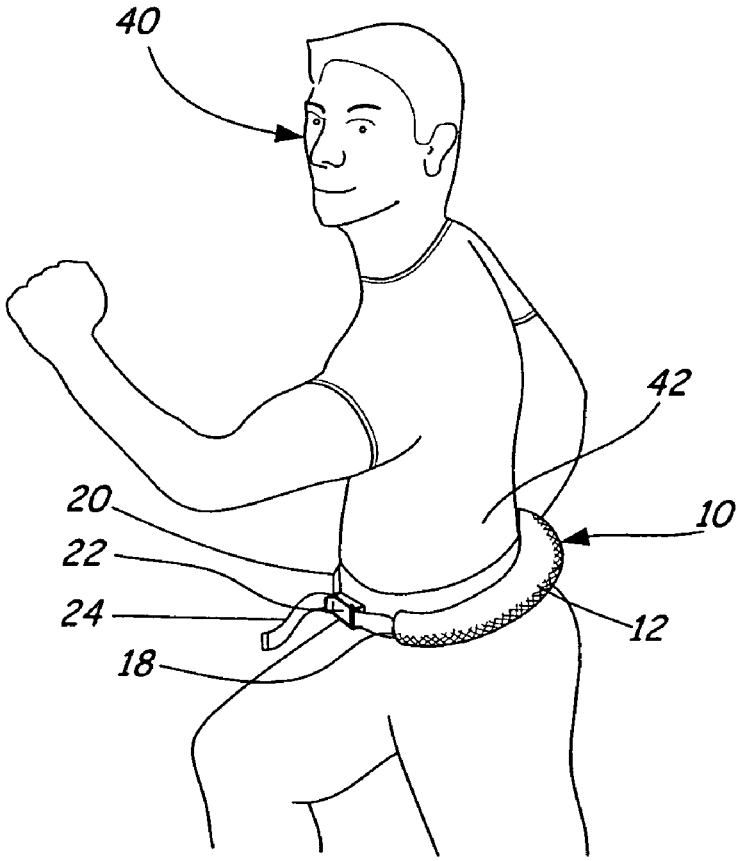
FIG. 3 is a perspective view of the elongated flexible weight secured in a loop about a waist of the exerciser.
Figure 4:
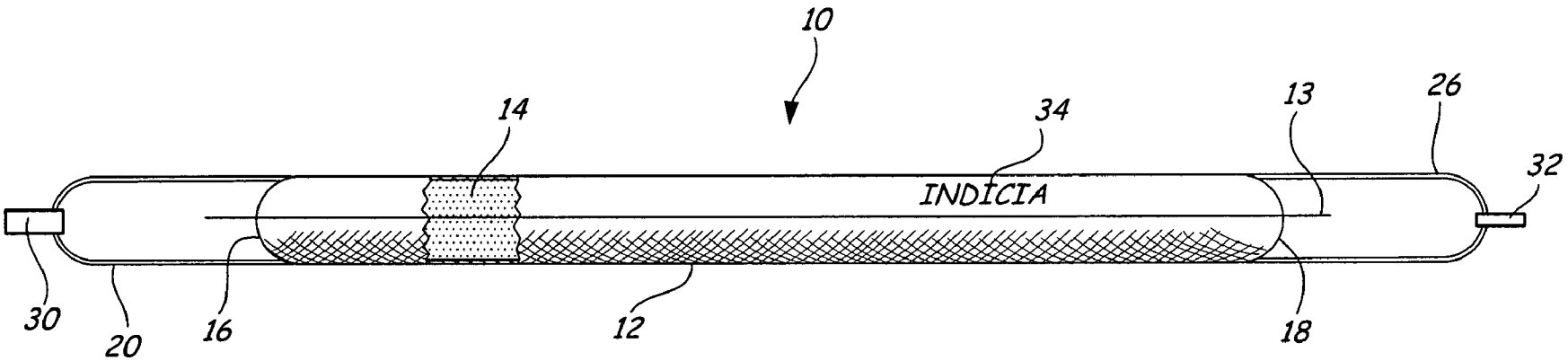
FIG. 4 is a top view of an alternative embodiment of the flexible weight of the present invention.
Figure 5:
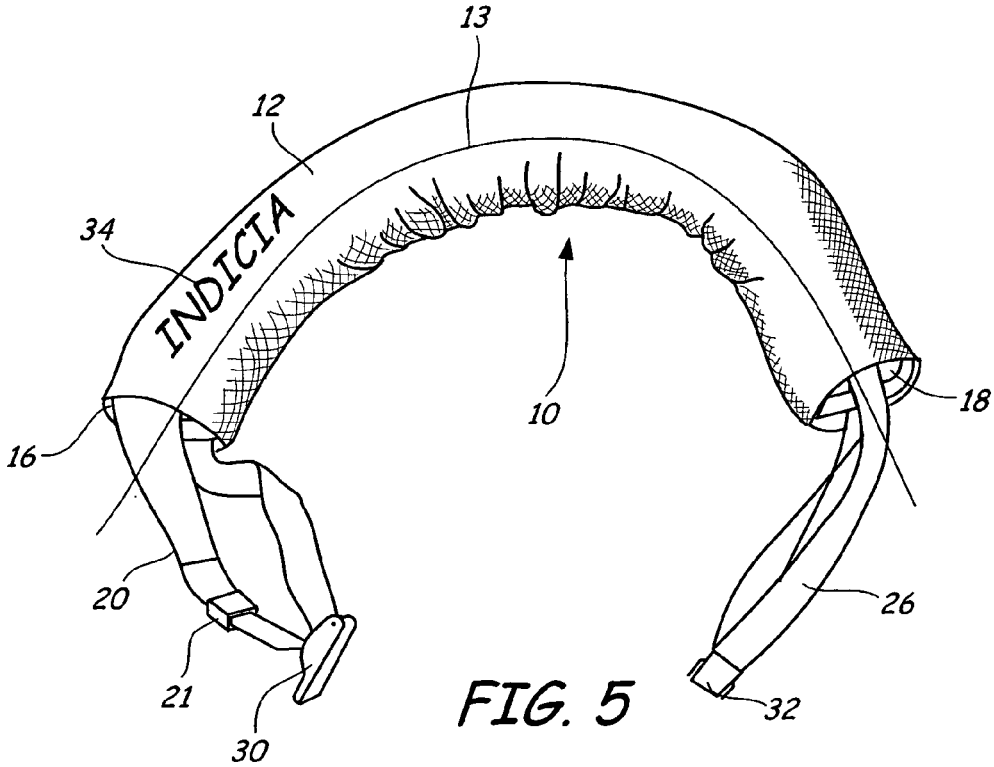
FIG. 5 is a perspective view of the alternative embodiment of the present invention in a curved position.
Figure 6:
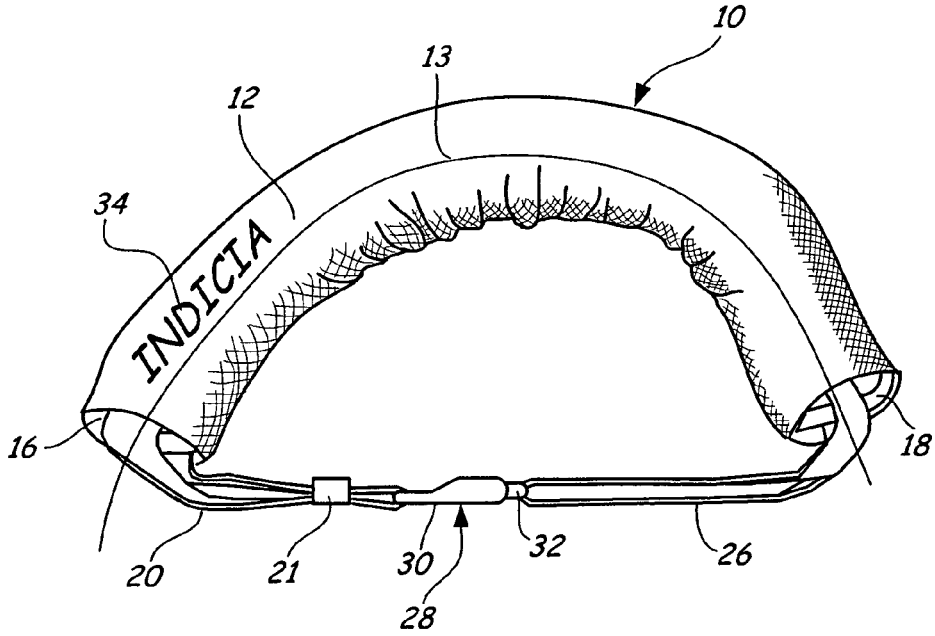
FIG. 6 is a perspective view of the alternative embodiment of the present invention in a loop configuration.

The tube 12 includes at least one loop 20 at one end 16 of the tube. The loop 20 can be used as a hand grip or a foot stirrup as well as being positioned on a limb. Preferably, a buckle 22 is attached to the loop 20 and engages a strap 24 attached to the other end 18 of the tube 12. The strap 24 can be used as a hand grip or positioned through the buckle 22 to define a loop of a selected perimeter. The buckle 22 secures the strap 24 in a selected position thereby securing the flexible weight 10 around a portion of the exerciser's body such as a torso or waist 42 of an exerciser 40 as best illustrated in FIG. 3. The exerciser can utilize the flexible weight 10 secured about the waist 42 while walking, jogging, in-line skating, or other aerobic activity such as martial arts and performing leg exercises including squats or lunges.

Referring to FIGS. 4-7, a second loop 26 can be attached to the other end 18 of the tube 12 instead of the strap 24. The second loop 26 can also be used as a hand grip or a foot stirrup. The loops 20, 26 define openings that are of size to receive an arm or leg of the exerciser 40. The loops 20, 26 and the strap 24 can be made of a material that can either be a non-stretch fabric, rope and the like, or if desired, can be an elastic material such as rubber or suitable elastomer. The material for the loops 20, 26 and the strap 24 can also run continuously along the entire outer or inner surface of the tube 12 to help in the structural integrity of the design.

At the outer end of each of the loops 20, 26, there alternatively may be an adjustable fastening mechanism 28 that includes mating elements 30, 32 that can be joined together or held together in some manner. A non-exhaustive list of fastening mechanisms 28 include a buckle, a snap, a hook and loop fastener such as that sold under the Velcro trademark and a buckle with a hasp engaging holes in the other loop. It is apparent that other types of fasteners can be used as well.

An adjusting buckle 21 is attached to the loop 20 to vary the overall circumference of the elongated weight 10 when positioned into a loop. It is apparent that a second adjusting buckle may also be attached to the loop 26 to further adjust the circumference of the elongated weight 10.

The tube 12 can be of any desired length, but for example, a length of about 3 feet has found to be acceptable. A tube diameter of approximately 3-4 inches also is found acceptable. This diameter can vary from about 2 inches up to about 12 inches depending on the weight that is desired. The particulate material 14 can be from 2 pounds up to in excess of 100 pounds depending on the desires of the users, and provides weight suitable for muscle exertion by the exerciser while exercising.

The tube 12 may have indicia 34 to indicate a selected weight or may have indicia which corresponds to a weight 34. By indicia is meant any distinctive marking such as printing, a color or a design.

Figure 7:
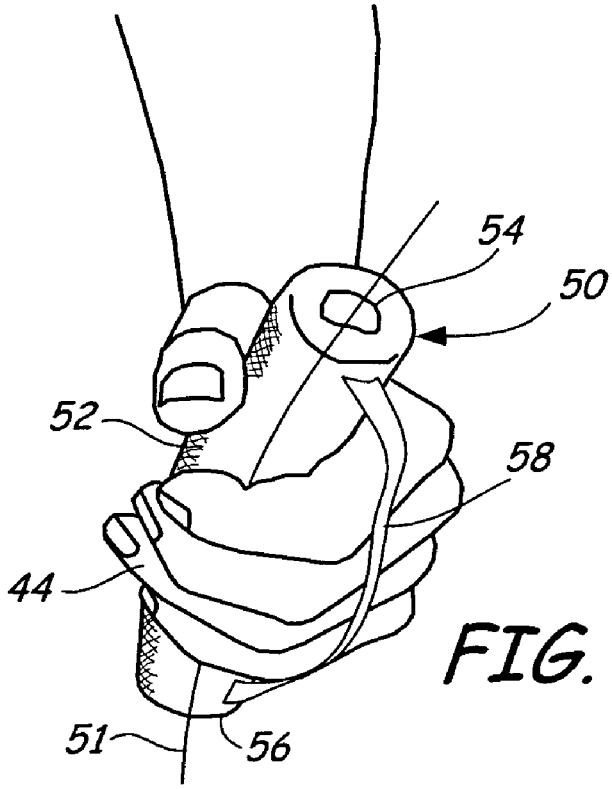
FIG. 7 is a perspective view of a flexible hand weight of the present invention.
Figure 8:
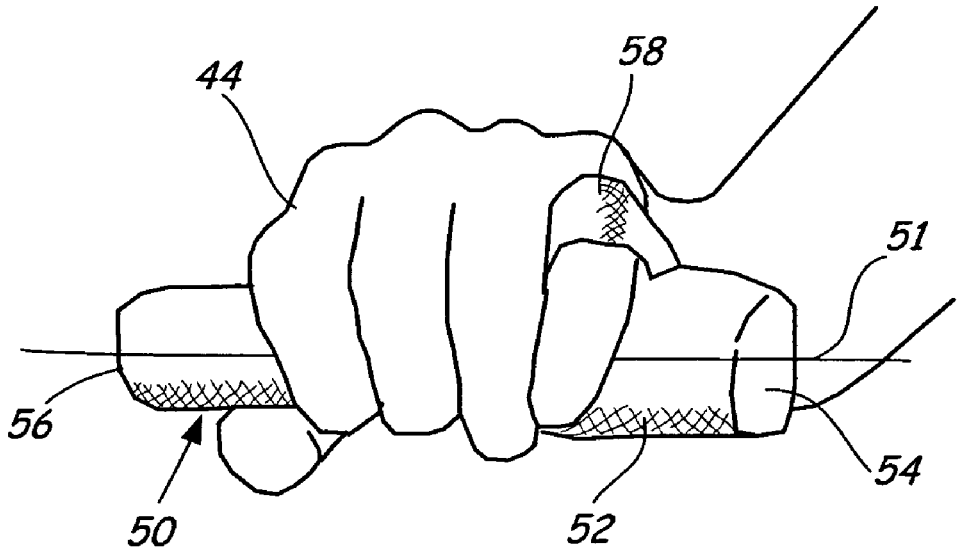
FIG. 8 is an alternative embodiment of the flexible hand weight of the present invention.

Referring to FIGS. 7 and 8, it is also within the scope of the present invention for a flexible weight 50 to be configured to be hand-held and having a generally cylindrical configuration with a central axis 51. The hand-held weights 50 include an elongated tube 52 that is filled with a selected amount of particulate material or granular material and is sealed at both ends 54, 56. The particulate material shifts within the tube 52 such that the hand-held weight conforms to a grip of the exerciser 40. The hand-held weights 50 are retained to the exerciser's hand 44 by a retaining strap 58. The retaining strap 58 is secured to the elongated sleeve 52 and can is sized to receive some or all of the digits of the hand.

The retaining strap 58 is sized to receive all four digits of the hand as illustrated in FIG. 7. Alternatively, the retaining strap 58 can be sized to receive only one digit as illustrated in FIG. 8. It is also within the scope of the present invention for the retaining strap 58 to receive two or three digits.

The elongated flexible weight 10 can be used separately from the hand held weights 50. The elongated flexible weight 10 can also be used at the same time as the hand held weights.

The flexible elongated weights 10, 50 can be used to perform all of the exercises that can be performed with a rigid barbell or dumbbell. One advantage of the flexible elongated weights 10, 50 is that the particulate material shifts within the tube 12, 52, thereby reducing or eliminating the likelihood of the exerciser injuring his/her foot or hand if the flexible weights 10, 50 is accidentally dropped upon the exerciser. The flexible weights 10, 50 when dropped will conform to the foot or hand and not injure the exerciser.

Figure 10:
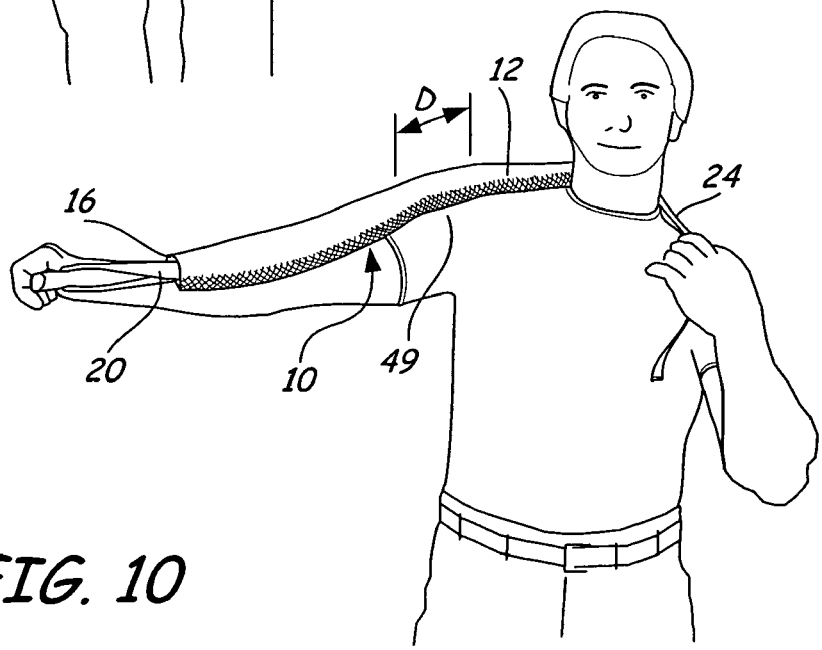
FIG. 10 is a perspective view of the exerciser of the present invention exercising shoulder muscles with less resistance than in FIG. 9.

Additionally, a single elongated flexible weight 10 is useful at providing different resistances depending upon a distance D from a center of gravity the flexible elongated weight 10 from the joint that is being articulated by flexing and isolating muscles or muscle groups. By way of example, referring to FIG. 10, the weight 10 may be positioned along a length of the arm 48, where the particulate material 14 shifts within the elongated tube to conform to the contour of the arm 48. Positioning the elongated weight 10 upon the arm 48 shifts the center of gravity proximate the shoulder joint defined by the distance D, and the resistance to the shoulder muscles is lessened as the arm is raised and lowered by articulating the shoulder joint 49.

Figure 9:
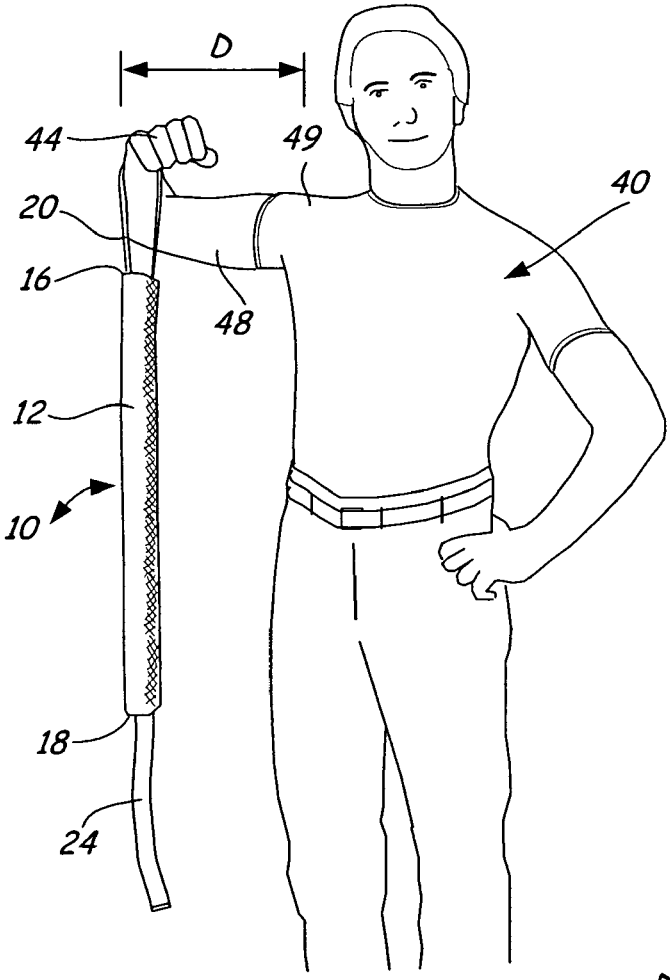
FIG. 9 is a perspective view of an exerciser resistance training with the flexible weight of the present invention being looped about a fore arm of the exerciser.

Referring to FIG. 9, when the same weight is hanging from the arm 48 near the hand 49, the resistance is increased as the arm 48 is raised and lowered by articulating the shoulder joint 49 because the center of gravity is a further distance D from the shoulder joint 49. The flexible weights can be positioned anywhere along the length of the arm 48 to increase or decrease the resistance by shifting the distance D from the center of gravity of the weight to the joint being articulated.

Referring to FIG. 20, the exerciser 40 can insert the arm through the loop 20 and coil the flexible weight 10 about the arm to adjust the distance D from the shoulder joint 49 to the center of gravity of the flexible weight 10 and thereby varying the resistance on the shoulder muscles. The coils can be moved toward the hand to increase the distance D and therefore the increase the resistance on the shoulder muscles or the coils can be shifted toward the shoulder joint 49 and thereby decrease the resistance on the shoulder muscles by decreasing the distance D.

As the weight 10 is positioned further from the articulating joint 49, the resistance is increased and as the weight 10 is positioned closer to the articulating joint 49, the resistance is decreased. Therefore, the exerciser can achieve a variety of resistances with the same flexible weight 10, and eliminates the need to add or reduce weight from a barbell or retrieve a different weighted dumbbell. Varying the position of the flexible weight 10 on a leg 47 to vary the resistance to a muscle or muscle group is also within the scope of the present invention.

Figure 11:
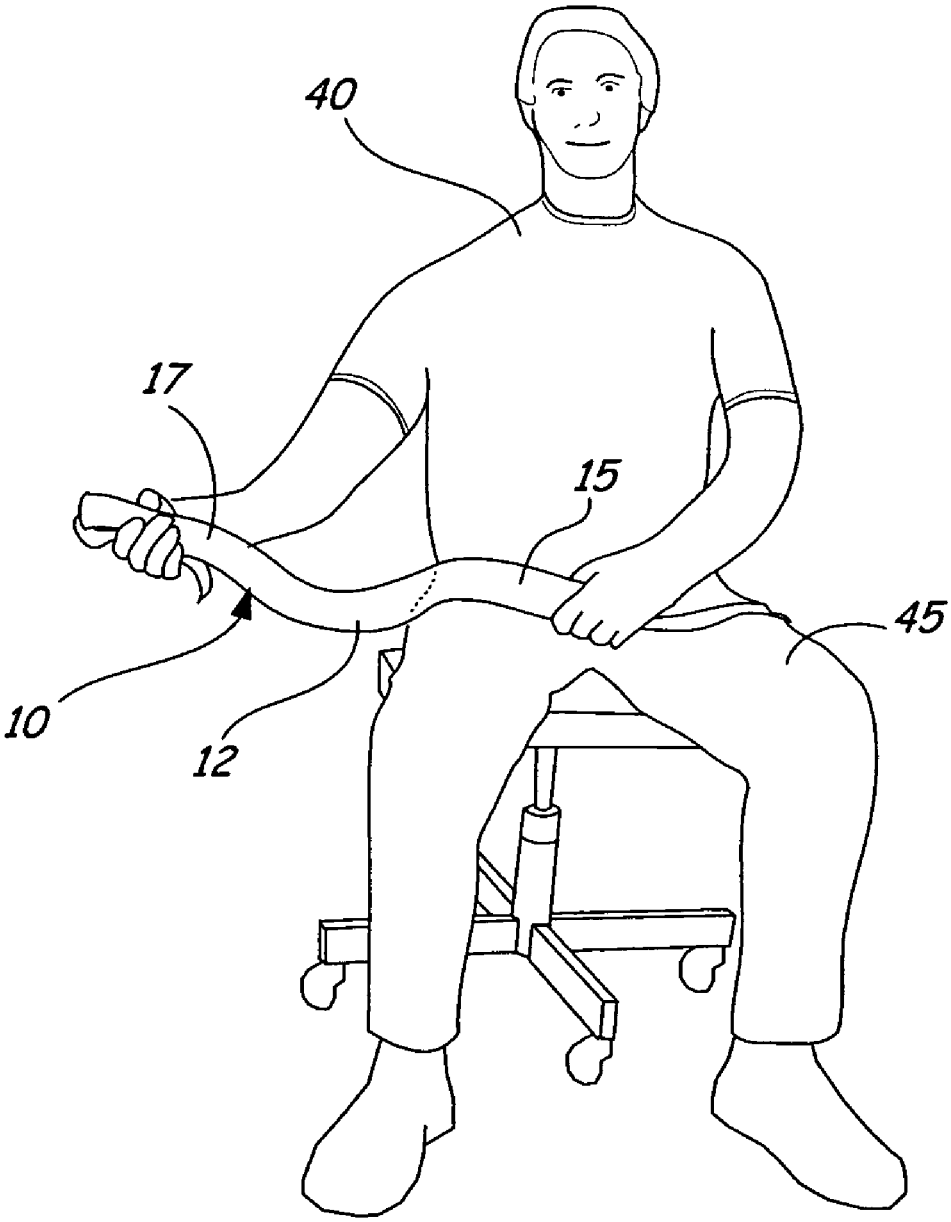
FIG. 11 is a perspective view of an exerciser using a single elongated weight to vary resistance.

Referring to FIG. 11, another method of use of a single flexible weight 10 that provides a varying amount of resistance is to place a first portion 15 of the flexible weight on a surface such as a bench or the exerciser's lap 45 and lifting only a second portion 17 of the weight 10 by articulating a joint or joints. As more of the weight 10 is positioned upon the surface or lap 45 by increasing a length of the first portion 15, the muscles used to articulate the joint incur less resistance. Conversely, as the length of the first position 15 decreases, the length of the second portion increases 17 and the resistance upon the muscles used to articulate the joint increases. By varying the lengths of the first portions 15 of the elongated flexible weight 10 upon the surface or lap 45, a length of the second portion 17 also varies and thereby varies the resistance to a muscle or group of muscles while employing only one weight. In contrast when rigid weights are used to exercise, different weights have to be added to or removed from a barbell or a different set of dumbbells must be used, both of which increase the time and inconvenience in exercising.

Figure 12:
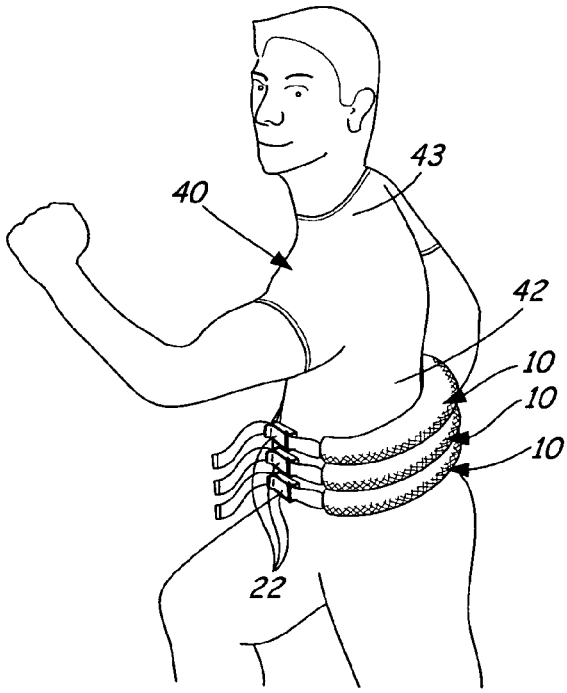
FIG. 12 is a perspective view of an exerciser using a plurality of flexible elongated weights positioned about the exercisers waist.

Referring to FIG. 12, the elongated flexible weight 10 of the present invention is also useful in quickly decreasing the amount of weight being lifted thereby allowing the exerciser to continue exercising as the isolated muscles fatigue. A plurality of elongated flexible weights 10 are positioned about the waist 42 or upon the nape 43. As the muscles being exercised fatigue one or more of the flexible weights 10 are removed from the exerciser by removing the weight from the nape of the neck or unfastening the buckle 22 and allowing the elongated weight 10 to drop. This procedure can be repeated until no elongated weights 10 remain on the exerciser 40.

The elongated flexible weight 10 and/or hand weights 50 are also useful in performing a number of exercises that can be performed using a barbell or a dumbbell. The flexibility of the elongated weight 10 allows a variety of exercises to be performed with a single weight.

Figure 13:
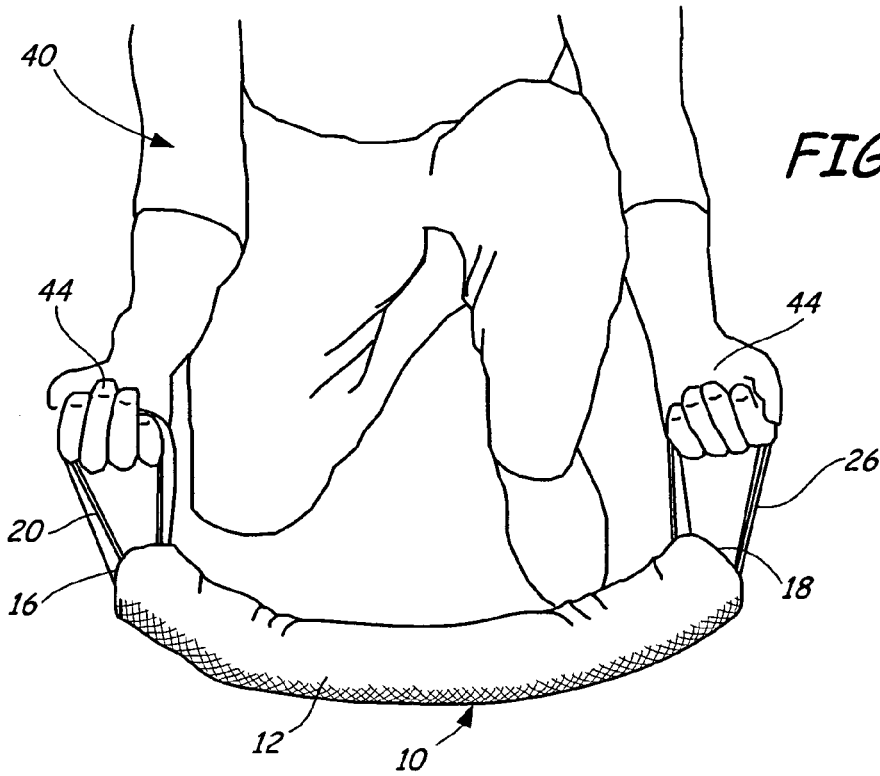
FIG. 13 is a partial perspective view of an exerciser gripping the first and second handle straps for doing lifting exercises.
Figure 14:
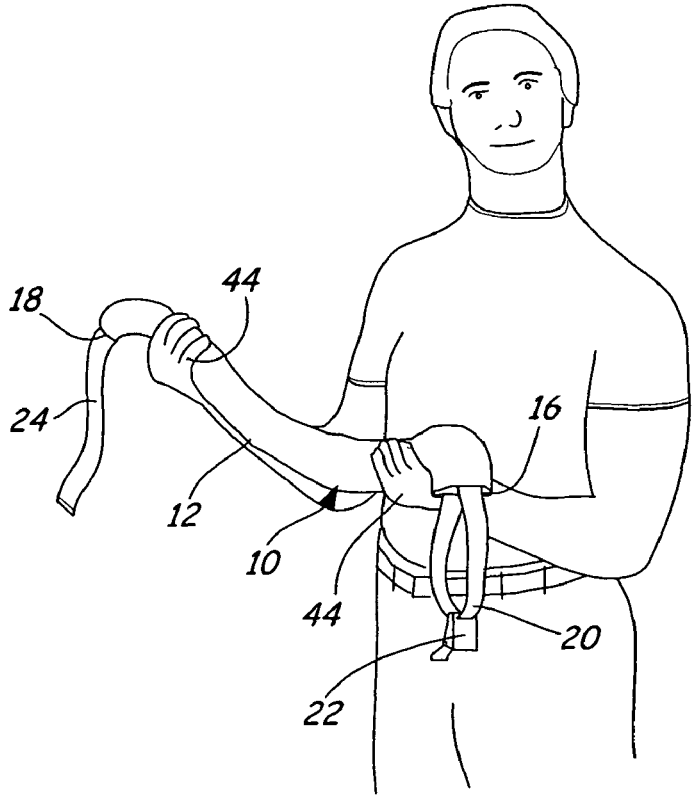
FIG. 14 is a perspective view of an exerciser gripping the elongated flexible weight and doing arm exercises.
Figure 15:
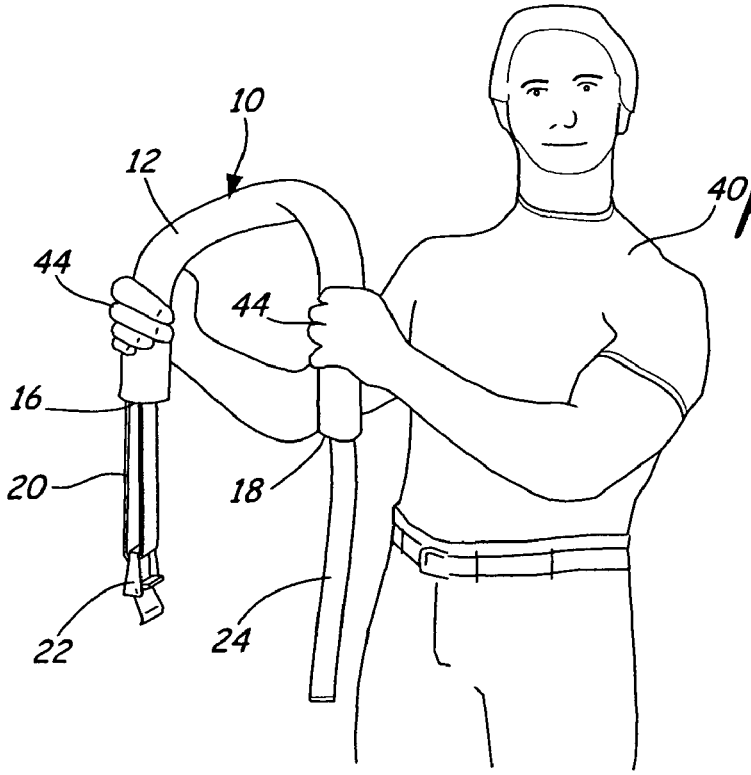
FIG. 15 is another perspective view of an exerciser gripping the elongated flexible weight and doing arm exercises.

FIG. 13 illustrates a user 40 holding the loops 20, 26 for lifting in the hands 44. Aside from grasping the loops 20, 26, the tube 12 itself can be gripped by the user's hand 44 at any portion along the tube 12, the exerciser 40 can perform various exercises and aerobic motions, like curls, press's and others, such as forearm exercises. FIG. 14 shows the exerciser 40 holding the elongated tube 12 proximate the ends 14, 16 with both hands for performing curls and other upper body exercises, thereby moving both arms simultaneously, or for moving one arm and then the other. Reversing the position of the weight 10 so the major portion of the tube 12 is above the hands 44, as illustrated in FIG. 15, permits the exerciser 40 to upright raise exercises and allows for additional exercising versatility.

Figure 16:
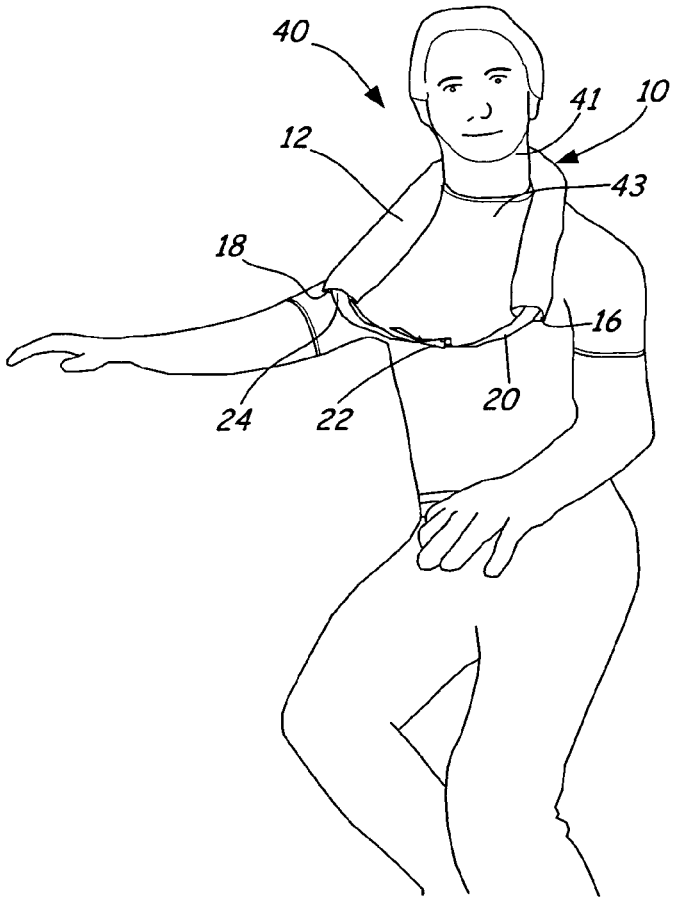
FIG. 16 is a perspective view of an exerciser employing a flexible elongated weight about a nape of the exerciser and performing leg exercises.
Figure 17:
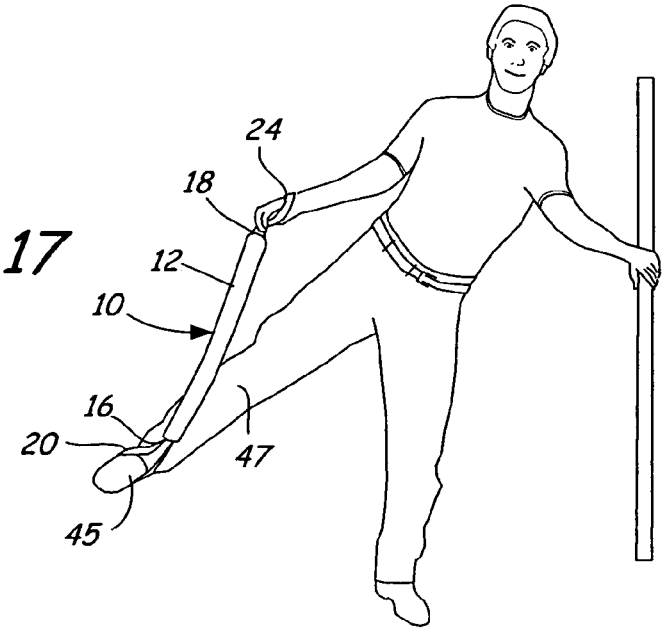
FIG. 17 is a perspective view of an exerciser engaging a foot through a loop of the elongated weight and performing leg exercises.

In FIG. 16, the weight 10 is formed into the loop and is placed around the neck 41 and about the nape 43 of a user 40. In this illustration, the elongated weight 10 adds additional weight to the body, so that doing "squats" by flexing the knees and hips exercises the leg muscles. When positioned about the nape 43, the elongated flexible weight 10 conforms to the exerciser's shoulders and chest, thereby allowing the back to be in the proper position because the weight is distributed about the spine. The position or location of the weight 10 also serves for adding resistance to movements like lunging, stepping, skating, walking and jogging.

FIG. 14 shows a leg raise exercise where a foot 45 is positioned within the loop 20. By inserting the foot 45 into the loop 18 and holding the weight along a leg 47, the leg muscles can be exercised by front, rear and sideways movement.

Figure 18:
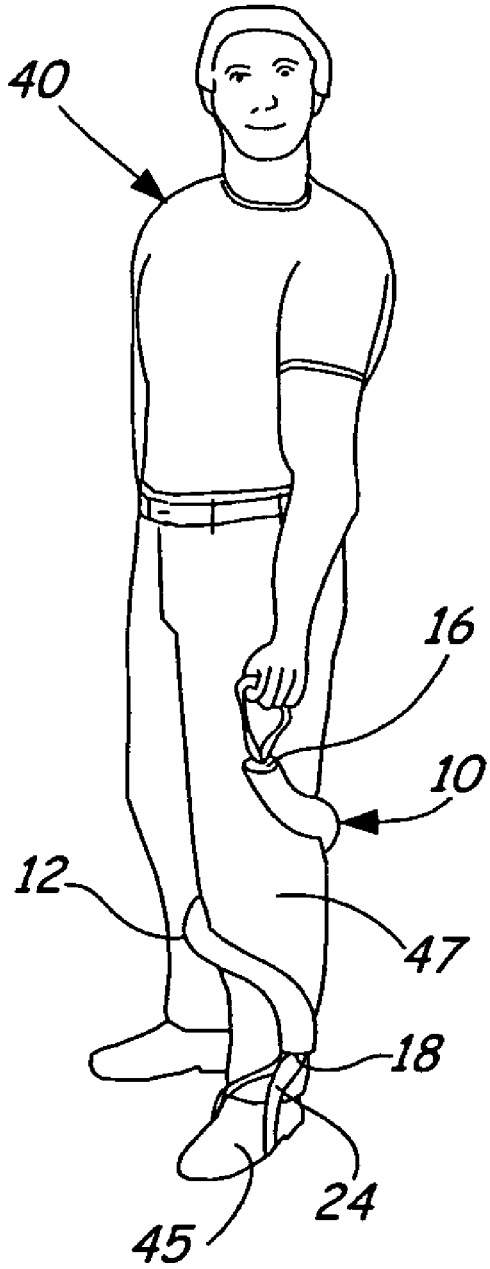
FIG. 18 is a perspective view of the exerciser coiling a flexible weight about a leg to reduce a resistance of the weight while performing leg exercises.

Referring to FIG. 18, the elongated weight 10 can be coiled about the leg 47 to move the center of gravity a distance from the articulated joint and thereby change the resistant to muscles being exercised with a single weight. As the coils are wound tightly to ward the foot 45, the center of gravity is shifted from the articulating hop or knee joint. Conversely, as the distance between the coils is increased, the center of gravity is shifted toward the articulating knee or hip joint thereby decreasing the resistance upon the muscles being exercised. The elongated weight 10 can also be coiled about the arm 48 in a similar fashion to increase or decrease the resistance while using a simple elongated weight.

Referring to FIG. 19, the exerciser 40 can lay on his/her side with the elongated weight 10 coiled about the leg 47 with the foot 45 positioned within the loop 20. The exerciser 40 grips the other loop 26 and can perform a variety of leg raises that exercise the upper leg, hip flexor and buttocks. By adjusting the position of the coils about the leg 47, the resistance created with one elongated weight 10 can be increased by positioning the coils proximate the foot 45 or the resistance decreased by spacing apart the coils such that a center of gravity is nearer the muscles being exercised.

Although the present invention has been described with reference to preferred embodiments, workers skilled in the art will recognize that changes may be made in form and detail without departing from the spirit and scope of the invention.

What is claimed is:

1. A hand held exercising device comprising:

a tube comprising a continuous side wall that connects a first end and a second end and a central axis, the continuous side wall having substantially uniform circumference sized for allowing the tube to be gripped around an entire perimeter of the side wall with a single hand and the tube having a length substantially similar to that of a width of a hand;

a particulate material of a selected weight within the tube and wherein the particulate material shifts within the tube such that the tube compresses when gripped within a palm of the exerciser's hand; and a loop having a first end and a second end attached to the side wall of the tube wherein the first end of the loop is attached to the side wall of the tube a first distance from the first end of the tube and the second end of the loop is attached to the side wall of the tube a second distance from the second end of the tube and wherein the loop accepts less than four digits of an exerciser's hand and wherein the first and second ends of the loop are attached to tube such that the loop is aligned with and spaced apart from the central axis of the tube.

2. The hand held exercise device of claim 1 and wherein the tube is closed at both the first end and the second end to retain the particulate matter.

3. The hand held exercise device of claim 2 and wherein the loop is attached to the tube between the first and second ends.

4. The hand held exercise device of claim 1 and wherein the loop is sized to accept only one digit of the exerciser's hand.

5. A exercising device for positioning within a palm of a hand the exercising device comprising:

a flexible tube comprising a continuous side wall that connects a first end and a second end and a central axis, the continuous side wall having a substantially uniform circumference sized for allowing the tube to be gripped around an entire perimeter thereof with an exerciser's hand and having a length substantially similar to that of a width of a hand;

a particulate material of a selected weight within the tube;

a sleeve positioned over the flexible tube; and a loop attached to the side wall of the sleeve wherein the first end of the loop is attached to the side wall of the sleeve a first distance from the first end of the sleeve and the second end of the loop is attached to the side wall of the sleeve a second distance from the second end of the sleeve and wherein the loop accepts no more than three digits of an exerciser's hand and wherein the loop is attached to the side wall of the sleeve such that the loop is aligned with and spaced apart from the central axis of the sleeve.

6. The exercising device of claim 5 and wherein the particulate material shifts within the tube such that the tube compresses when gripped.

7. The exercising device of claim 5 and wherein the tube is closed at both the first end and the second end to retain the particulate matter.

8. The hand held exercise device of claim 5 and wherein the loop is attached to the tube between the ends.

9. The hand held exercise device of claim 5 and wherein the loop accepts one digit of the exerciser's hand.

10. A exercising device for positioning within a palm of a hand the exercising device comprising:

a tube comprising a continuous side wall that connects a first end and a second end and a central axis, the continuous side wall having a substantially uniform circumference sized for allowing the tube to be gripped around an entire perimeter thereof with an exerciser's hand and having a length substantially similar to that of a width of a hand;

a particulate material of a selected weight within the tube; and a loop attached to the side wall of the tube and wherein the loop accepts four or less digits of an exerciser's hand and wherein the loop is attached to the side wall wherein the first end of the loop is attached to the side wall of the tube a first distance from the first end of the tube and the second end of the loop is attached to the side wall of the tube a second distance from the second end of the tube such that the loop is aligned with and spaced apart from the central axis of the tube and engages a back side of the exerciser's hand when utilized by the exerciser such that the tube is retained to the exerciser's hand independent of whether the tube is gripped.

11. The exercise device of claim 10 and wherein the loop is configured to accept four digits of the user's hand and the loop engages the back side of the exerciser's hand to retain the tube to the user's hand.

12. The exercise device of claim 10 and wherein the loop is configured to accept three or less digits of the user's hand and the loop engages the back side of the exerciser's hand to retain the tube to the user's hand.

13. The exercise device of claim 10 and wherein the loop is configured to accept one digit of the user's hand and the loop engages the back side of the exerciser's hand to retain the tube to the user's hand.

* * * * *